US011889932B2

(12) United States Patent
Tan

(10) Patent No.: US 11,889,932 B2
(45) Date of Patent: Feb. 6, 2024

(54) CHILD PLAY ENCLOSURE FRAME

(71) Applicant: Aspire Kunshan, Limited, Kunshan (CN)

(72) Inventor: Yepeng Tan, Kunshan (CN)

(73) Assignee: Aspire Kunshan, Limited, Kunshan (CN)

( * ) Notice: Subject to any disclaimer, the term of this patent is extended or adjusted under 35 U.S.C. 154(b) by 309 days.

(21) Appl. No.: 17/420,319

(22) PCT Filed: Jan. 7, 2020

(86) PCT No.: PCT/CN2020/070689
§ 371 (c)(1),
(2) Date: Jul. 1, 2021

(87) PCT Pub. No.: WO2020/143623
PCT Pub. Date: Jul. 16, 2020

(65) Prior Publication Data

US 2022/0087445 A1 Mar. 24, 2022

(30) Foreign Application Priority Data

Jan. 8, 2019 (CN) ..... 201910017113.5

(51) Int. Cl.
*A47D 13/06* (2006.01)

(52) U.S. Cl.
CPC ..... *A47D 13/061* (2013.01)

(58) Field of Classification Search
CPC .... A47D 13/06; A47D 13/061; A47D 13/063; A47D 13/065; A47D 13/066; A47D 13/068
See application file for complete search history.

(56) References Cited

U.S. PATENT DOCUMENTS 6,065,163 A * 5/2000 Hung ..... A47D 13/063 5/98.1
6,317,907 B1 * 11/2001 Wang ..... A47D 13/063 5/98.1
7,836,530 B2 * 11/2010 Thorne ..... A47D 13/063 5/98.1

(Continued)

FOREIGN PATENT DOCUMENTS

CN 102727008 A 10/2012
CN 101674759 B 11/2013

(Continued)

*Primary Examiner* — Justin C Mikowski
*Assistant Examiner* — George Sun
(74) *Attorney, Agent, or Firm* — Hinckley, Allen & Snyder, LLP; David R. Josephs

(57) ABSTRACT

A child play enclosure frame, comprising: a plurality of vertical rods respectively provided with upper frame corner joints and lower frame corner joints, an upper frame. When the child play enclosure frame is in the unfolded position, the lower frame structure is stable. When the upper center set performs an upward relative motion relative to the lower center set, the triangular mechanism and the four-linkage mechanism deform simultaneously, which may force the plurality of vertical rods to remain upright or remain in a state of being approximately upright and synchronously drawing together towards the center, which forces the entire play enclosure frame to fold and collapse.

10 Claims, 7 Drawing Sheets

(56) References Cited

U.S. PATENT DOCUMENTS

| | | | | |
|---|---|---|---|---|
| 8,973,181 | B2 * | 3/2015 | Thorne | A47D 13/061 5/99.1 |
| 9,179,786 | B1 | 11/2015 | Ransil et al. | |
| 10,709,260 | B2 * | 7/2020 | Huang | A47D 7/002 |
| 11,589,685 | B2 * | 2/2023 | Bastien | A47D 13/063 |
| 2006/0021138 | A1 * | 2/2006 | Waldman | A47D 13/063 5/99.1 |
| 2012/0248394 | A1 * | 10/2012 | Thorne | A47D 13/061 256/25 |
| 2015/0027343 | A1 | 1/2015 | Son et al. | |

FOREIGN PATENT DOCUMENTS

| | | | |
|---|---|---|---|
| CN | 203 735 845 | U | 7/2014 |
| CN | 204120651 | U | 1/2015 |
| CN | 104323625 | A | 2/2015 |
| CN | 107518684 | A | 12/2017 |
| CN | 107997485 | A | 5/2018 |
| CN | 108 209 317 | A | 6/2018 |
| CN | 208 048 461 | U | 11/2018 |
| CN | 109619911 | A | 4/2019 |
| CN | 210095250 | U | 2/2020 |
| CN | 210095251 | U | 2/2020 |

* cited by examiner

CHILD PLAY ENCLOSURE FRAME

BACKGROUND OF THE INVENTION

The present invention relates to a child play enclosure frame.

A child play enclosure frame of the prior art comprises a plurality of vertical rods, each provided with an upper frame corner joint and a lower frame corner joint, a collapsible upper frame connected to the plurality of upper frame corner joints, a collapsible lower frame connected to the plurality of lower frame corner joints, an upper frame locking device used to lock the upper frame in the extended position, and a lower frame locking device used to lock the lower frame in the extended position, wherein the lower frame comprises a central seat located at its center, and a plurality of bottom link sets connecting the central seat with the corresponding lower frame corner joints; the number of vertical rods is the same as that of the bottom link sets; as shown in the patent publication referenced CN101674759B, the bottom link set comprises an upper leg and a lower leg, which are separately connected to the installation structure between the center and the vertical rods to form a four-link mechanism.

SUMMARY OF THE INVENTION

The technical problem to be solved by the present invention is to provide a child play enclosure frame.

To solve the above technical problem, the technical solution used in the present invention is: a child play enclosure frame, comprising a plurality of vertical rods, each provided with an upper frame corner joint and a lower frame corner joint, a collapsible upper frame connected to the plurality of upper frame corner joints, a collapsible lower frame connected to the plurality of lower frame corner joints, and an upper frame locking device used to lock the upper frame in the extended position, wherein the lower frame comprises a central seat located at its center, and a plurality of bottom link sets connecting the central seat with the corresponding plurality of lower frame corner joints; the number of vertical rods is the same as the number of bottom link sets; the central seat comprises an upper center set and a lower center set that can move vertically relative to each other; each of the bottom link sets comprises a first bottom rod and a second bottom rod that are pivotally connected around a first bottom axle; one end of a third bottom rod plus the second bottom rod are pivotally connected around a second bottom axle, wherein one end of the first bottom rod and the upper center set are pivotally connected around a third bottom axle; one end of the second bottom rod plus the lower center set are pivotally connected around a fourth bottom axle; the other end of the first bottom rod and the upper part of the lower frame corner joint are pivotally connected around a fifth bottom axle; and the other end of the third bottom rod and the lower part of the lower frame corner joint are pivotally connected around a sixth bottom axle.

In one embodiment, the upper frame comprises a plurality of sets of enclosure rod assemblies, each arranged between two adjacent upper frame corner joints, and each set of enclosure rod assemblies comprises a left and a right frame rod, each with one end rotationally connected to the corresponding upper frame corner joint, and an intermediate member located between the other ends of the two frame rods, wherein the other end of each of the frame rods is connected to the corresponding side of the intermediate member so that it can slide to the left and to the right and can also rotate around a first top axle; an upper frame locking device is arranged between the intermediate member and the other ends of the two frame rods so that when the upper frame locking device is in the locked position, the upper frame locking device is firmly locked under the tension between the two frame rods that tend to move away from each other, and when the two frame rods of each set move toward each other, the corresponding upper frame locking device is switched from the locked position to an unlocked position.

In one embodiment, a guide groove is formed on the other end of each of the frame rods; the first top axle is fixed on the corresponding side of the intermediate member, and the first top axle is movably and rotatably inserted into the guide groove. The upper frame locking device comprises a locking groove formed on each of the two sides of the intermediate member, and two locks respectively fixed on the other end of the frame rods, wherein each locking groove comprises a locking groove section extending along the left and right directions and an escape space connected with the locking groove section. When the upper frame locking device is in the locked position, the lock is inserted in the locking groove section; when the upper frame locking device is in the unlocked position, the lock is removed from the locking groove section and moved into the escape space.

In one embodiment, an unlocking elastic piece is provided between the frame rod and the first top axle, which allows the frame rod to slide so that the lock tends to escape from the locking groove section.

In one embodiment, one end of each of the frame rods and the corresponding upper frame corner joint are pivotally connected around a second top axle.

In one embodiment, the first bottom rod and the third bottom rod are respectively pivotally connected to the upper and lower parts of the lower frame corner joint, wherein the distance from the pivot at the upper part to the center line of the central seat is greater than the distance from the pivot at the lower part to the center line of the central seat.

In one embodiment, the upper center set and the lower center set are detachably connected.

In one embodiment, a lower frame locking device is provided between the upper center set and the lower center set.

In one embodiment, the lower frame locking device comprises an upper socket protruding downward from the upper center set, a lower frame bolt arranged on the upper socket and sliding only along the horizontal direction, as well as a control member arranged in the upper socket and sliding only in the vertical direction, wherein the control member and the lower frame bolt are fitted to slide along a diagonal; the lower frame locking device further comprises a lower spigot protruding upward from the lower center set that can be inserted into the upper socket, wherein the lower spigot is provided with a lock notch, and the upper socket is provided with a locking elastic piece that allows the lower frame bolt to fit into the lock notch when popping out.

In one embodiment, the upper frame comprises a plurality of sets of enclosure rod assemblies, each arranged between two adjacent upper frame corner joints; one end of the frame rod of each set of enclosure rod assemblies and the corresponding upper frame corner joint are rotationally connected to the second top axle; and the other end of the frame rod can move relative to the intermediate member and is arranged to rotate around the first top axle. The first top axle is located below the connecting line of two adjacent second top axles; and the tension when the two frame rods move away from each other causes the upper frame locking device to switch from the unlocked position to the locked position.

In one embodiment, there are four vertical rods.

The scope of the present invention is not limited to the technical solutions formed by specific combinations of the above technical features, but shall also cover other technical solutions formed by any combination of the above technical features or their equivalent features. For example, it shall cover a technical solution formed by substituting the above features (without limitation thereto) with technical features having similar functions as disclosed in this application.

Thanks to the application of the above technical solutions, the present invention has the following advantages compared with the prior art: the present invention provides a new folding concept, wherein each bottom link set, the upper center set and the lower center set form a deformable triangle mechanism, and each bottom link set the upper center set and the lower center set form a deformable four-link mechanism with the vertical rods. When the child play enclosure frame is in the extended position, the lower frame is structurally stable. When the upper center set moves up relative to the lower center set, the triangle mechanism and the four-link mechanism are deformed simultaneously, which can keep the plurality of vertical rods vertical or substantially vertical as they move synchronously away from or toward the center so that the entire play enclosure frame folds and collapses.

DESCRIPTION OF THE INVENTION

Figure 1:
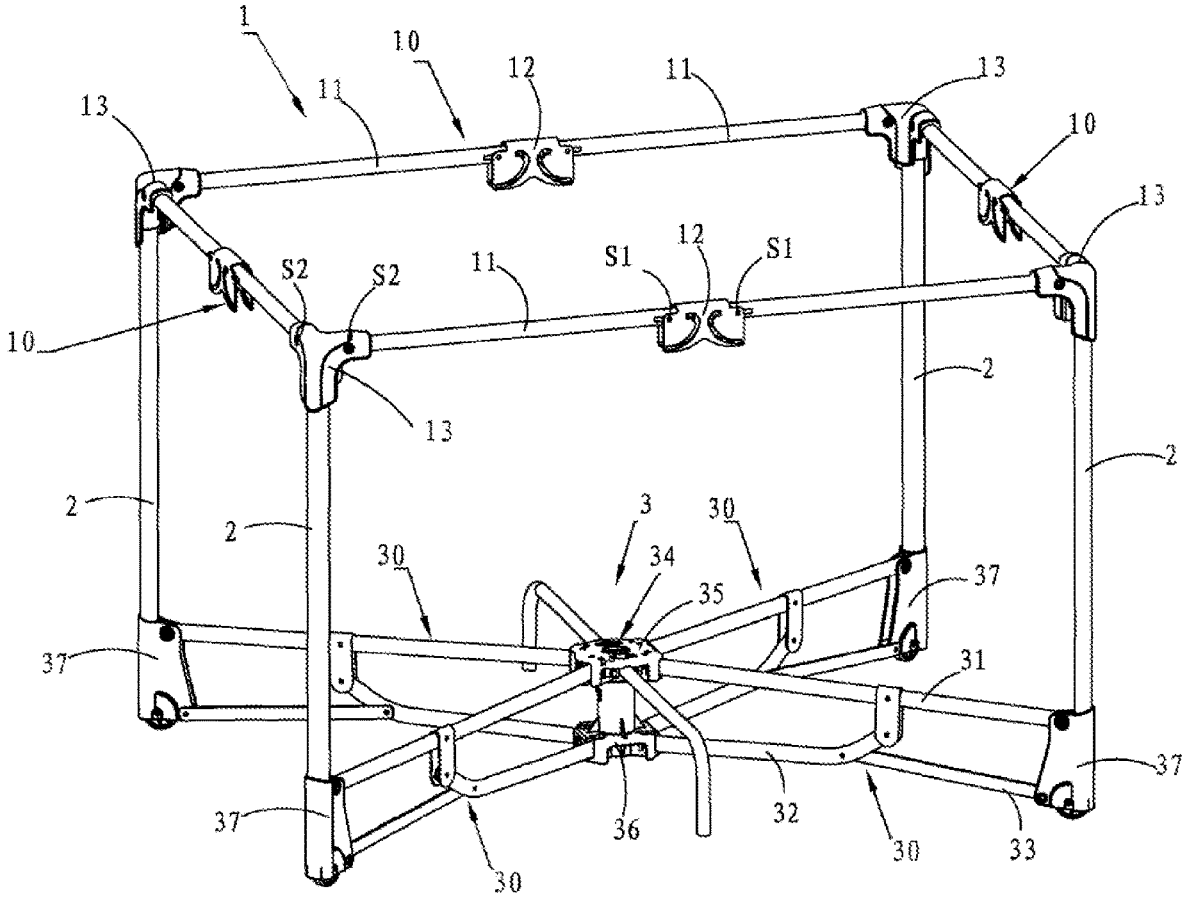
FIG. 1 is a schematic 3D view of a child play enclosure frame in the extended position (embodiment 1)
Figure 2:
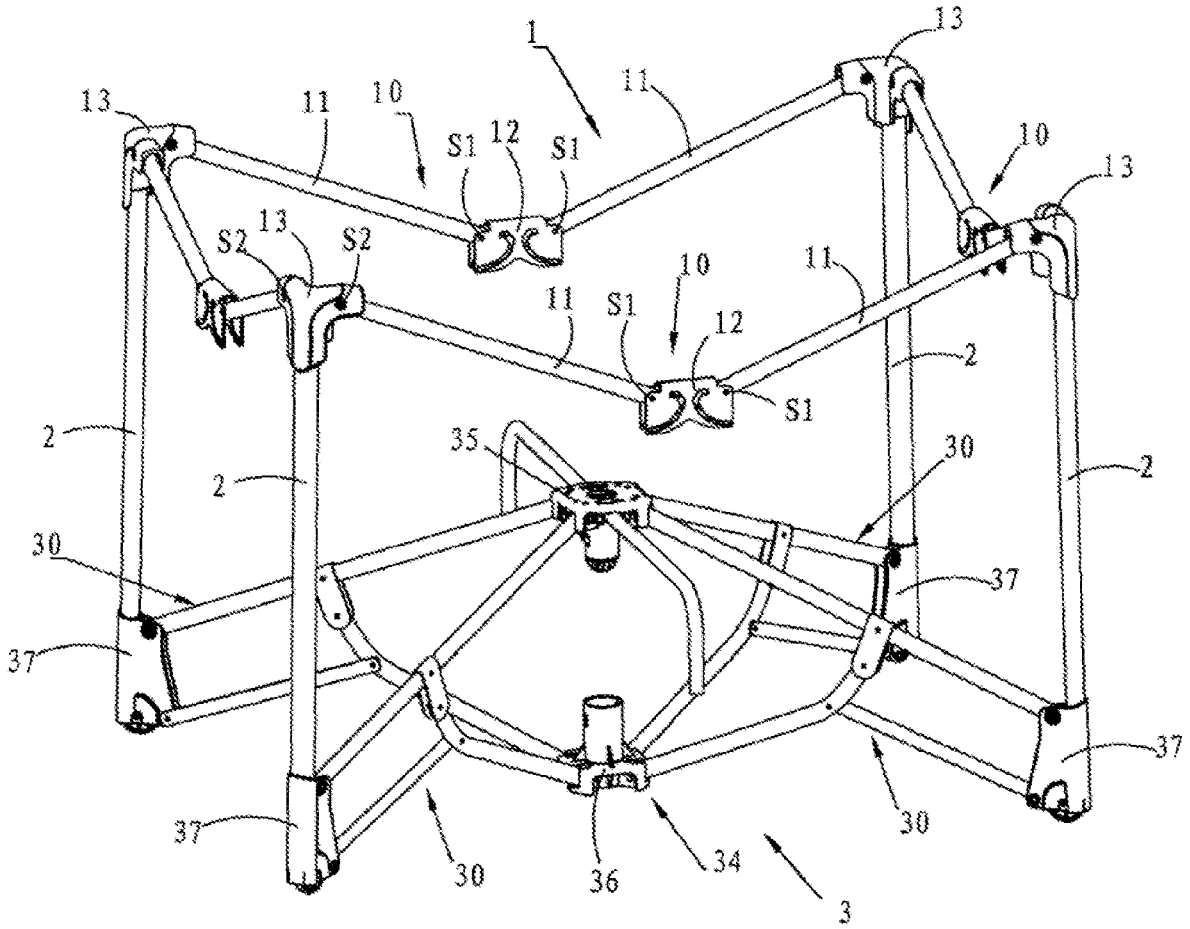
FIG. 2 is a schematic 3D view of a child play enclosure frame during the folding process (embodiment 1)
Figure 3:
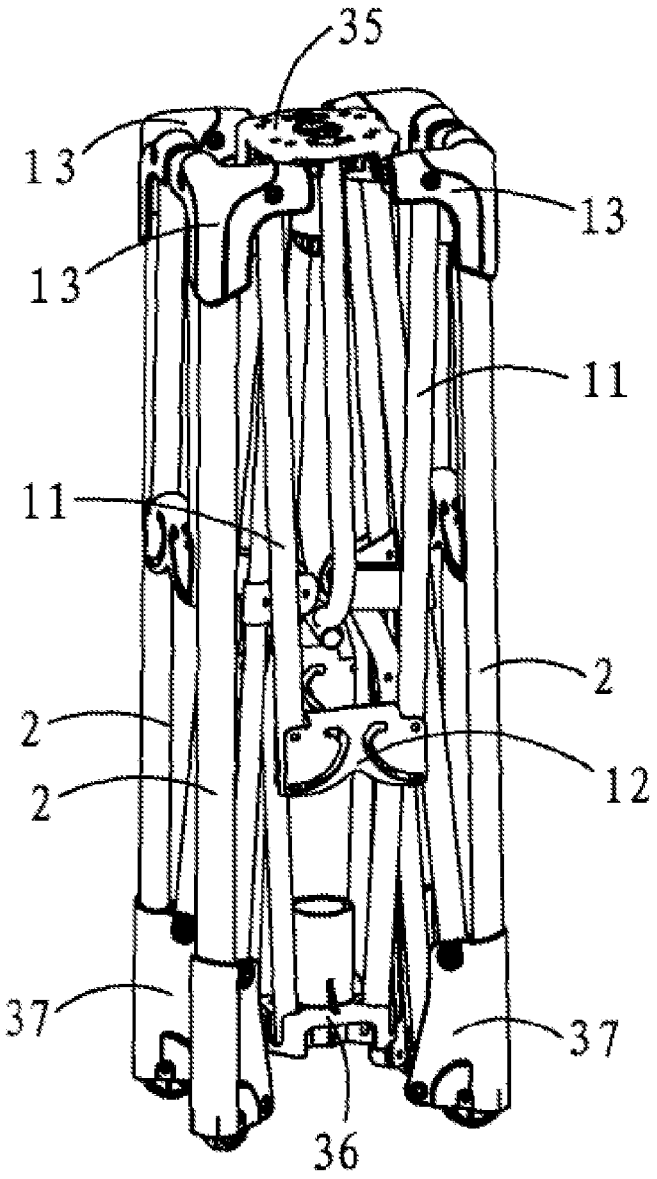
FIG. 3 is a schematic 3D view of a child play enclosure frame in the folded position.
Figure 4:
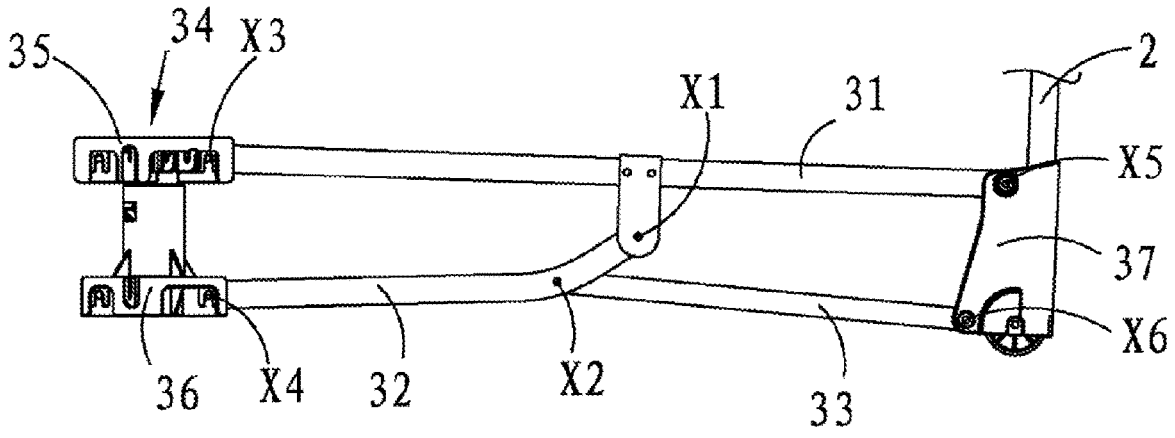
FIG. 4 is a schematic view of a detail of the bottom link set (embodiment 1)

As shown in FIGS. 1-4, embodiment 1 is a child play enclosure frame, comprising a plurality of vertical rods 2, each provided with an upper frame corner joint 13 and a lower frame corner joint 37, a collapsible upper frame 1 connected to the plurality of upper frame corner joints 13, a collapsible lower frame 3 connected to the plurality of lower frame corner joints 37, an upper frame locking device 100 used to lock the upper frame 1 in the extended position, and a lower frame locking device used to lock the lower frame in the extended position.

In this embodiment, the number of vertical rods 2 is four, so that the frame is a regular cuboid or cube shape in the stable extended state.

The lower frame 3 comprises a central seat 34 located at its center, and a plurality of bottom link sets 30 connected between the central seat 34 and the corresponding lower frame corner joints 37. The number of vertical rods 2 is the same as the number of bottom link sets 30.

The central seat 34 comprises an upper center set 35 and a lower center set 36 that can move vertically relative to each other, wherein the upper center set 35 and the lower center set 36 can be detached, and, when detached, they can move toward and away from each other along a straight line due to the symmetry of the surrounding bottom link sets 30. Hence, the upper center set 35 and the lower center set 36 that can move vertically along a straight line may also be understood as collapsible rod members.

Each bottom link set 30 comprises a first bottom rod 31 and a second bottom rod 32 that are pivotally connected around a first bottom axle X1; one end of a third bottom rod 33 and the second bottom rod 32 are pivotally connected around a second bottom axle X2. One end of the first bottom rod 31 and the upper center set 35 are pivotally connected around a third bottom axle X3, and one end of the second bottom rod 32 and the lower center set 36 are pivotally connected around a fourth bottom axle X4. The other end of the first bottom rod 31 and the upper part of the lower frame corner joint 37 are pivotally connected around a fifth bottom axle X5, while the other end of the third bottom rod 33 and the lower part of the lower frame corner joint 37 are pivotally connected around a sixth bottom axle X6. A mounting seat is fixed on the first bottom rod 31; and the second bottom rod 32 plus the mounting seat are pivotally connected around the first bottom axle XI.

Each bottom link set 30, the upper center set 35 and the lower center set 36 form a deformable triangle mechanism, and each bottom link set 30, the upper center set 35 and the lower center set 36 form a deformable four-link mechanism with the vertical rods 2. When the child play enclosure frame is in the extended position, the upper center set is in contact with the lower center set, and the lower frame structure is in the only stable extended state. In this state, the four vertical rods 2 remain vertical, thus forming the foundation for the tension generated when the frame rods 11 of the same set, which are described below, tend to move away from each other. When the upper center set moves up relative to the lower center set, the triangle mechanism and the four-link mechanism deform simultaneously, thus keeping the plurality of vertical rods vertical or substantially vertical as they move synchronously toward the center, and also moving the frame rods 11, which are described below, toward each other so that the entire play enclosure frame folds and collapses.

Figure 9:
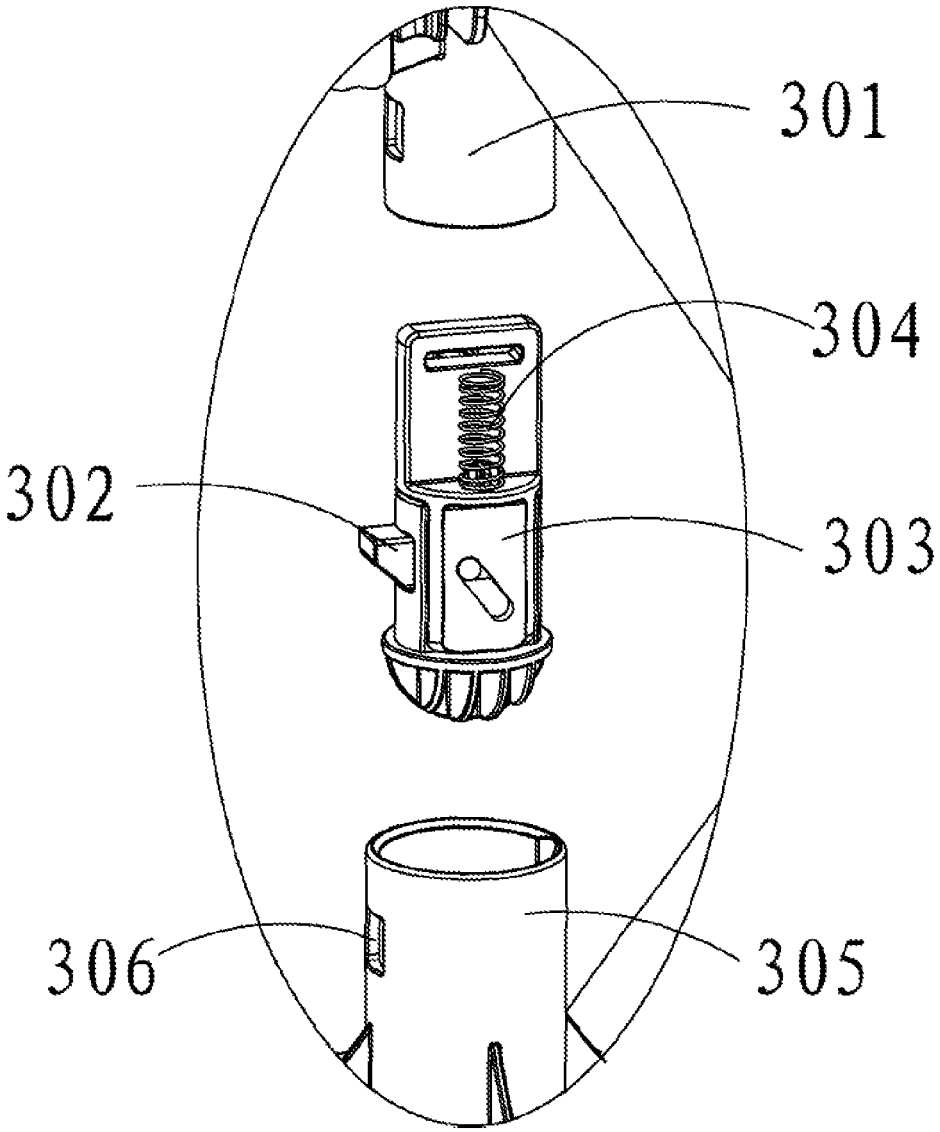
FIG. 9 is a schematic exploded view of the detail of the lower frame locking device.

When the child play enclosure frame is in the extended position, the upper center set 35 and the lower center set 36 are pressed against each other in the vertical direction under force of gravity, and the lower frame 3 will stay extended even if it is not locked. However, for the sake of safety and stability, a lower frame locking device is provided between the upper center set 35 and the lower center set 36. There can be multiple locking designs, as long as the upper center set 35 and the lower center set 36 will not easily move apart. In this embodiment, as shown in the detailed exploded view of the lower frame locking device in FIG. 9, the lower frame locking device comprises an upper socket 301 protruding downward from the upper center set 35, a lower frame bolt 302 arranged on the upper socket 301 and sliding only along the horizontal direction, and a control member 303 arranged in the upper socket 301 and sliding only in the vertical direction, wherein the control member 303 and the lower frame bolt 302 are fitted so as to slide along a diagonal; the lower frame locking device further comprises a lower spigot 305 protruding upward from the lower center set 36 that can be inserted into the upper socket 301, wherein the lower spigot 305 is provided with a lock notch 306, and the upper socket 301 is provided with a locking elastic piece 304 that allows the lower frame bolt 302 to fit into the lock notch 306 when popping out. When locked, the lower frame bolt 302 pops out and is inserted into the lock notch 306. When the control member 303 is pulled up against the elastic force of the locking elastic member 304, under the action of the diagonal movement, the lower frame bolt 302 retracts inward to unlock. Not shown in the figures, the lower frame locking device may also be designed such that an elastic hook is arranged rotationally on the upper center set 35, and a lock ring is arranged on the lower center set 36, wherein the lower frame is locked when the elastic hook is hooked with the lock ring, and the upper center set 35 and the lower center set 36 form a whole.

The upper frame 1 comprises four sets of enclosure rod assemblies 10, respectively arranged between two adjacent upper frame corner joints 13. Each set of enclosure rod assemblies 10 comprises two frame rods 11, respectively on the left and on the right, having one end plus the corresponding upper frame corner joint 13 pivotally connected around the second top axle S2, and an intermediate member 12 located between the other ends of the two frame rods 11. The other end of each frame rod 11 is connected to the corresponding side of the intermediate member 12 in such a way that it can slide to the left and right and also rotate around the first top axle S1. When the upper frame 1 is in the extended position, the first top axle S1 of each set of enclosure rod assemblies 10 is located below the horizontal connecting line between two adjacent second top axes S2. An upper frame locking device 100 is provided between the intermediate member 12 and the other end of the two frame rods 11. When the upper frame locking device 100 is in the locked position, the tension between the two frame rods 11 that tend to move away from each other keeps the upper frame locking device 100 stably in the locked position. When the two frame rods 11 of each set move toward each other, the corresponding upper frame locking device 100 is switched from the locked position to the unlocked position.

Figure 7:
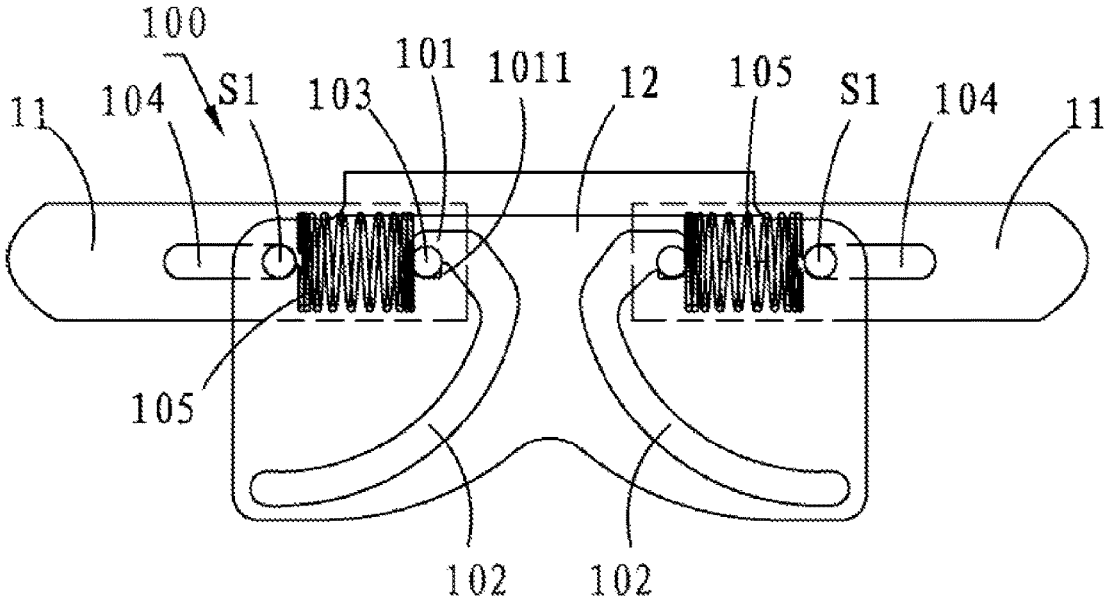
FIG. 7 is a schematic view of the detailed structure of the upper frame locking device of embodiment 1.

As shown in FIG. 7, in the structure of the upper frame locking device in embodiment 1, the other end of each frame rod 11 is provided with a guide groove 104 along the length of the rod, the first top axle S1 being fixed on the corresponding side of the intermediate member 12, and the first top axle S1 being movably and rotatably inserted into the guide groove 104. The upper frame locking device 100 comprises locking grooves respectively formed on the left and right sides of the intermediate member 12, and two locks 103 respectively fixed on the other end of the frame rod 11. Each locking groove comprises a locking groove section 101 extending in the left and right directions, and an escape space 102 connected with the locking groove section 101. In this embodiment, it is an arc-shaped groove. In fact, however, the shape of the escape space 102 is not limited, as long as it does not affect the movement of the lock 103. When the upper frame locking device 100 is in the locked position, the tension between the two frame rods 11 that tend to move away from each other keeps the lock 103 stably inserted in the locking groove section 101. Because the locking groove section extends in the left and right directions, it prevents the frame rods 11 from rotating around the first top axle S1. When the upper frame locking device 100 is in the unlocked position, the two frame rods 11 move toward each other, so that the lock 103 separates from the locking groove section 101 and moves into the escape space 102, and the frame rods 11 can rotate around the first top axle S1. A damping protrusion is provided on the lower surface of the locking groove section 101. Since the intermediate member 12 will arch upward when the two frame rods 11 move toward each other, the damping protrusion does not affect the lock 103 leaving the locking groove section 101, but the damping protrusion can enhance stability in the locked position.

The four vertical rods 2 are kept vertical, and an appropriate length is provided for each frame rod 11, so that when the frame rods 11 of the same set move away from each other, they will straighten and generate tension, and the upper frame locking mechanism will automatically lock. An unlocking elastic member 105 is provided between the frame rods 11 and the first top axle S1. When the child play enclosure frame is folded, the two frame rods 11 slide relative to each other, thereby facilitating the release of the lock 103 from the locking groove section 101 and making folding easier.

Figure 8:
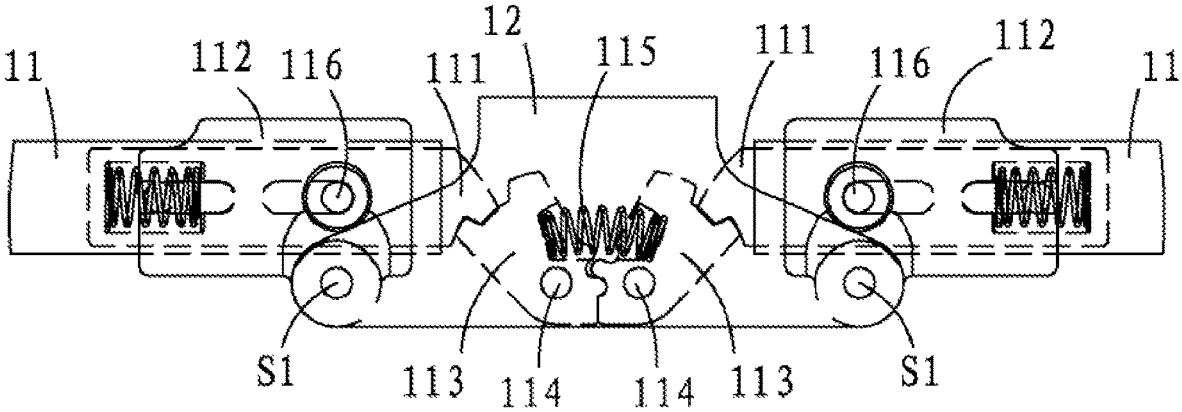
FIG. 8 is a schematic view of the detailed structure of the upper frame locking device of embodiment 2.

As shown in FIG. 8, in the structure of embodiment 2 of the upper frame locking device, the upper frame locking device 100 comprises two rotating seats 112, which respectively slide along the length of the frame rods 11 and are arranged at the other end thereof, two upper frame bolts 111 being respectively fixed at the corresponding rotating seat 112, the two latches 113, which respectively rotate around a rotating disc axle 114 and are arranged on the intermediate member 12, and a latch elastic piece 115 that moves the two latches 113, respectively, move toward the corresponding upper frame bolt 111 to fit therewith. Each rotating seat 112 and the corresponding side of the intermediate member 12 are rotatably connected to the first top axle S1. When the upper frame locking device 100 is in the locked position, the two frame rods 11 are straightened, the upper frame bolts 111 extend out, and the latches 113 abut the upper frame bolts 111 to prevent the upper frame bolts 111 from moving down around the first top axle S1. When the two frame rods 11 move toward each other, the upper frame bolts 111 retract into the frame rods 11 and respectively abut the corresponding latch 113, and, because the intermediate member 12 will arch, the latches 113 are forced to deviate from the corresponding upper frame bolt 111 at this point, thus allowing the upper frame bolts 111 to move down around the first top axle S1.

Figure 5:
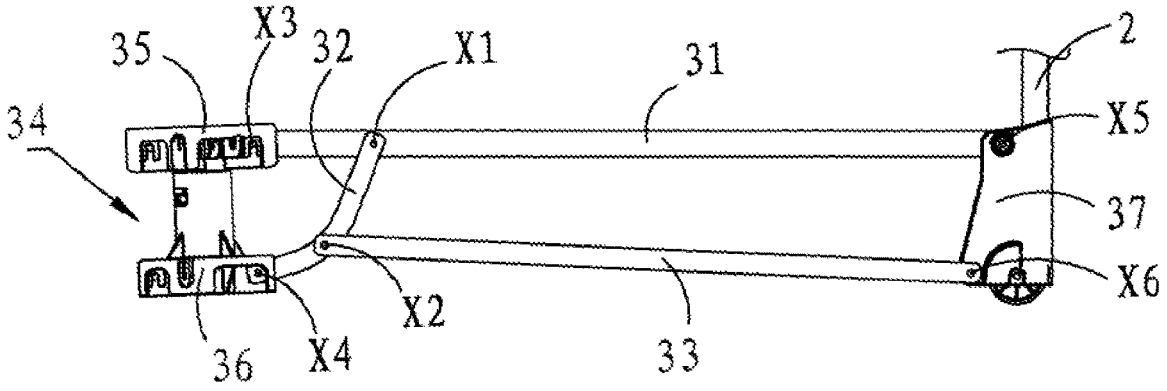
FIG. 5 is a schematic view of a detail of the bottom link set (embodiment 2)
Figure 6:
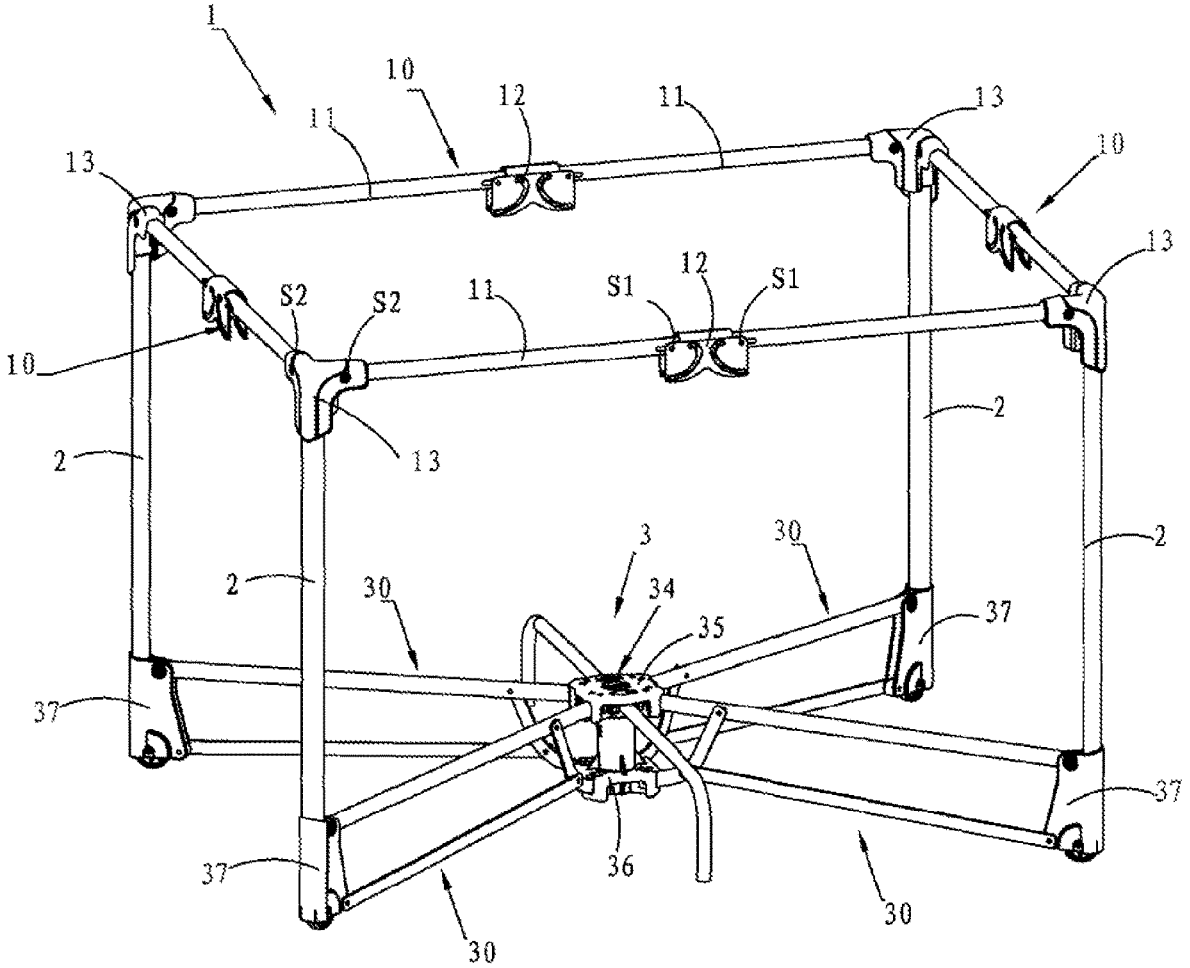
FIG. 6 is a schematic 3D view of a child play enclosure frame in the extended position (embodiment 2)

Embodiment 2 is shown in FIGS. 5 and 6. The only difference between embodiment 2 and embodiment 1 is the position of the first bottom axle XI and of the second bottom axle X2. In embodiment 2, the first bottom axle XI and the second bottom axle X2 are closer to the central seat 34, thus giving a different visual effect. But this does not affect the principle of action of the rods. The folding principle of embodiment 2 is the same as that of embodiment 1.

The above embodiments are only illustrating the technical concept and features of the present invention, and their purpose is to enable those skilled in the art to understand the content of the present invention and implement them accordingly, but do not limit the scope of the present invention. All equivalent changes or modifications made according to the concept of the present invention shall be covered within the scope of the present invention.

The invention claimed is:

1. A child play enclosure frame, comprising a plurality of vertical rods, each provided with an upper frame corner joint and a lower frame corner joint, a collapsible upper frame connected to a plurality of the upper frame corner joints, a collapsible lower frame connected to a plurality of the lower frame corner joints, and an upper frame locking device used to lock the upper frame in an extended position, wherein the lower frame comprises a central seat located at its center, and a plurality of bottom link sets connecting the central seat with a corresponding plurality of the lower frame corner joints, and the number of the vertical rods is the same as that of the bottom link sets, wherein, the central seat comprises an upper center set and a lower center set that can move vertically relative to each other; each of the bottom link sets comprises a first bottom rod and a second bottom rod that are pivotally connected around a first bottom axle; one end of a third bottom rod plus the second bottom rod are pivotally connected around a second bottom axle, wherein one end of the first bottom rod and the upper center set are pivotally connected around a third bottom axle; one end of the second bottom rod and the lower center set are pivotally connected around a fourth bottom axle; the other end of the first bottom rod and an upper part of the lower frame corner joint are pivotally connected around a fifth bottom axle; and the other end of the third bottom rod and the lower part of the lower frame corner joint are pivotally connected around a sixth bottom axle.

2. The child play enclosure frame according to claim 1, wherein the upper frame comprises a plurality of sets of enclosure rod assemblies, each arranged between two adjacent upper frame corner joints, and each set of enclosure rod assemblies comprises a left and a right frame rod, each with a first end rotationally connected to a corresponding upper frame corner joint and a second end opposite to the first end, and an intermediate member located between the second ends of the two frame rods, wherein the second end of each of the frame rods is connected to the corresponding side of the intermediate member so that it can slide to the left and right and also rotate around the first top axle; an upper frame locking device is arranged between the intermediate member and the second end of the two frame rods such that when the upper frame locking device is in a locked position, the upper frame locking device is firmly locked under the tension between the second end of the two frame rods where the second end of the left frame rod tends to move away from the second end of the right frame rod, and when the second end of the two frame rods of each set move toward each other, the corresponding upper frame locking device is switched from the locked position to an unlocked position.

3. The child play enclosure frame according to claim 2, wherein a guide groove is formed on the second end of each of the frame rods; the first top axle is fixed on a corresponding side of the intermediate member; and the first top axle is movably and rotatably inserted in the guide groove, the upper frame locking device comprises a locking groove formed on each of the two sides of the intermediate member, and two locks, respectively fixed on the second end of the frame rods; each locking groove comprises a locking groove section extending along the left and right directions, and an escape space connected with the locking groove section, such that when the upper frame locking device is in the locked position, the lock is inserted in the locking groove section, and when the upper frame locking device is in the unlocked position, the lock is removed from the locking groove section and moved into the escape space.

4. The child play enclosure frame according to claim 3, wherein an unlocking elastic piece is provided between the frame rod and the first top axle, which allows the frame rod to slide so that the lock tends to escape from the locking groove section.

5. The child play enclosure frame according to claim 2, wherein one end of each of the frame rods and a corresponding upper frame corner joint are pivotally connected around a second top axle.

6. The child play enclosure frame according to claim 1, wherein the first bottom rod and the third bottom rod are respectively pivotally connected to the upper and lower parts of the lower frame corner joint, wherein a distance from a pivot at the upper part to the center line of the central seat is greater than a distance from a pivot at the lower part to the center line of the central seat.

7. The child play enclosure frame according to claim 1, wherein the upper center set and the lower center set are detachably connected.

8. The child play enclosure frame according to claim 1, wherein a lower frame locking device is provided between the upper center set and the lower center set.

9. The child play enclosure frame according to claim 8, wherein the lower frame locking device comprises an upper socket protruding downward from the upper center set, a lower frame bolt arranged on the upper socket and sliding only along the horizontal direction, and a control member arranged in the upper socket and sliding only in the vertical direction, wherein the control member and the lower frame bolt are fitted to slide along a diagonal; the lower frame locking device further comprises a lower spigot which protrudes upward from the lower center set and can be inserted into the upper socket, wherein the lower spigot is provided with a lock notch, and the upper socket is provided with a locking elastic piece that allows the lower frame bolt to fit into the lock notch when popping out.

10. The child play enclosure frame according to claim 1, wherein the upper frame comprises a plurality of sets of enclosure rod assemblies, each arranged between two adjacent upper frame corner joints; one end of the frame rod of each set of the enclosure rod assembly a the corresponding upper frame corner joint are rotationally connected to the second top axle, and the other end of the frame rod can move relative to the intermediate member and is arranged to rotate around the first top axle; the first top axle is located below a connecting line of two adjacent second top axes such that a tension is created when the two frame rods move away from each other and causes the upper frame locking device to switch from an unlocked position to a locked position.

* * * * *